US009328577B2

(12) United States Patent
Hallundbæk et al.

(10) Patent No.: US 9,328,577 B2
(45) Date of Patent: May 3, 2016

(54) WIRELESS DOWNHOLE UNIT

(75) Inventors: Jorgen Hallundbæk, Græsted (DK); Jesper Oluf Larsen, Vallensbæk Strand (DK)

(73) Assignee: WELLTEC A/S, Allerød (DK)

( * ) Notice: Subject to any disclaimer, the term of this patent is extended or adjusted under 35 U.S.C. 154(b) by 354 days.

(21) Appl. No.: 13/989,216

(22) PCT Filed: Nov. 23, 2011

(86) PCT No.: PCT/EP2011/070819
§ 371 (c)(1),
(2), (4) Date: May 23, 2013

(87) PCT Pub. No.: WO2012/069540
PCT Pub. Date: May 31, 2012

(65) Prior Publication Data

US 2013/0240197 A1 Sep. 19, 2013

(51) Int. Cl.

| | |
|---|---|
| ***E21B 47/12*** | (2012.01) |
| ***E21B 23/00*** | (2006.01) |
| ***E21B 41/00*** | (2006.01) |

(52) U.S. Cl.
CPC ..... *E21B 23/00* (2013.01); *E21B 41/0085* (2013.01); *E21B 2023/008* (2013.01)

(58) Field of Classification Search
CPC ..... E21B 41/00; E21B 44/02; E21B 43/00; E21B 23/00; E21B 23/02
USPC ..... 175/102, 92, 314; 166/312, 381
See application file for complete search history.

(56) References Cited

U.S. PATENT DOCUMENTS

| | | | | |
|---|---|---|---|---|
| 6,405,798 | B1 * | 6/2002 | Barrett | E21B 17/028 166/250.01 |
| 6,454,011 | B1 | 9/2002 | Schempf et al. | |
| 6,722,442 | B2 | 4/2004 | Simpson | |
| 2003/0017383 | A1 * | 1/2003 | Ura | F28D 15/0275 429/120 |
| 2003/0234110 | A1 | 12/2003 | McGregor | |
| 2006/0126249 | A1 * | 6/2006 | Boling | H02J 7/0031 361/103 |
| 2007/0128513 | A1 * | 6/2007 | Hatta | H01M 2/021 429/176 |
| 2008/0142215 | A1 | 6/2008 | Pabon et al. | |

(Continued)

FOREIGN PATENT DOCUMENTS

| | | |
|---|---|---|
| RU | 2236549 | 9/2004 |
| RU | 2353751 | 4/2009 |
| RU | 2363831 | 8/2009 |

(Continued)

OTHER PUBLICATIONS

P.M. Snider. RFID Actuation of Self Powered Downhole Tools. Apr. 1-2, 2008. 2008 SPE/ICoTA Coiled Tubing and Well Intervention Conference and Exhibition held in The Woodlands, Texas, USA. SPE 113842. pp. 1 and 2.*

(Continued)

*Primary Examiner* — David Bagnell
*Assistant Examiner* — Manuel C Portocarrero
(74) *Attorney, Agent, or Firm* — Nixon & Vanderhye P.C.

(57) ABSTRACT

The present invention relates to a wireless downhole unit (1) adapted to be lowered into a well (2) in a casing (3) having an inner wall (4) and an inner diameter (Dc). The wireless downhole unit comprises an electrical motor (5), a pump (6), and driving means (7) for allowing movement of the wireless downhole unit within the casing, and at least one battery pack (8). The present invention further relates to a downhole system.

15 Claims, 5 Drawing Sheets

(56) References Cited

U.S. PATENT DOCUMENTS

| | | | | |
|---|---|---|---|---|
| 2008/0241675 | A1* | 10/2008 | Enari | H01M 2/105 429/179 |
| 2012/0215348 | A1* | 8/2012 | Skrinde | B08B 9/049 700/245 |

FOREIGN PATENT DOCUMENTS

| | | |
|---|---|---|
| WO | WO 93/18277 | 9/1993 |
| WO | WO 98/02634 | 1/1998 |

OTHER PUBLICATIONS

International Preliminary Report on Patentability issued in International Application No. PCT/EP2011/070819 dated May 28, 2013.

International Search Report for PCT/EP2011/070819, mailed Dec. 30, 2011.

Written Opinion of the International Searching Authority for PCT/EP2011/070819, mailed Dec. 30, 2011.

* cited by examiner

WIRELESS DOWNHOLE UNIT

This application is the U.S. national phase of International Application No. PCT/EP2011/070819, filed 23 Nov. 2011, which designated the U.S. and claims priority to EP Application No. 10192382.9, filed 24 Nov. 2010, the entire contents of each of which are hereby incorporated by reference.

FIELD OF THE INVENTION

The present invention relates to a wireless downhole unit adapted to be lowered into a well in a casing having an inner wall and an inner diameter. The wireless downhole unit comprises an electrical motor, a pump, and driving means for allowing movement of the wireless downhole unit within the casing, and at least one battery pack. The present invention further relates to a downhole system.

BACKGROUND ART

During oil production, it may become necessary to perform maintenance work in a well or to open a production well. Such well work is known as well intervention. A production casing is arranged inside the well and is closed by a well head in its upper end. The well head may be placed on shore, on an oil rig or on the seabed.

In order to lower and raise the tool into and out of the well and supply the tool with electricity, the tool is connected to a wireline at its top, which is fed through the well head. In order to seal the well while performing the operation using the tool, the wireline passes through a high-pressure grease injection section and sealing elements for sealing around the wireline.

In order to seal around the wireline as it passes through the grease injection section, high-pressure grease is pumped into the surrounding annulus to effect a pressure-tight dynamic seal which is maintained during the operation by injecting more grease as required. A slight leakage of grease is normal, and the addition of fresh grease allows for the consistency of the seal to be maintained at an effective level. In this way, grease leaks from the grease injection section into the sea during an intervention operation, which is not environmentally desirable. Due to the increasing awareness of the environment, there is a need for a more environmentally friendly solution.

SUMMARY OF THE INVENTION

It is an object of the present invention to wholly or partly overcome the above disadvantages and drawbacks of the prior art. More specifically, it is an object to provide an improved wireless tool for operating in the well without the use of a wireline or a similar power line.

The above objects, together with numerous other objects, advantages, and features, which will become evident from the below description, are accomplished by a solution in accordance with the present invention by a wireless downhole unit adapted to be lowered into a well in a casing having an inner wall and an inner diameter, comprising:

- an electrical motor,
- a pump,
- driving means for allowing movement of the wireless downhole unit within the casing,
- at least one battery pack comprising at least one battery for powering the electrical motor driving the pump driving the driving means to move the unit along the inner wall of the casing, wherein the unit comprises an expandable device having a centre and being expandable from a first diameter to a second diameter, the expandable device has an aperture in the centre, and a turbine is arranged in fluid connection with the aperture for recharging the battery.

In one embodiment, part of the turbine may be arranged in the aperture.

Said turbine may comprise an impeller arranged in fluid connection with the aperture for recharging the battery.

Moreover, the turbine may comprise a propeller arranged in fluid connection with the aperture for recharging the battery.

Also, the turbine may comprise a generator rotated by a shaft connected with the impeller or propeller of the turbine.

Further, the turbine may comprise a gear arranged between the generator and the shaft.

In one embodiment, the battery pack may comprise a plurality of batteries and a battery holder for holding the batteries.

The battery may be rechargeable.

Furthermore, the battery may be a lithium battery.

Additionally, the battery may be a high voltage battery of nominally at least 3 volts.

Moreover, the battery holder may be made of a heat-resistant material.

The holder being made of a heat-resistant material ensures that it maintains its shape despite the high pressure and temperature surrounding the unit downhole, preventing the batteries from losing electrical contact with the tool when the holder changes shape. The holder also protects the batteries from this high temperature and pressure. Using high voltage batteries increases the precautionary measures with regard to safety.

The heat-resistant material may be polyamide or peek.

The battery pack may furthermore comprise a battery housing enclosing the battery holder, forming a longitudinal space therebetween, in which the batteries can be arranged and connected in series while being kept in place.

By being housed in a battery holder, the batteries are kept firmly in place during bumping, allowing use of high voltage batteries in a downhole tool.

The battery housing may have an openable panel for inserting batteries into the battery pack.

Furthermore, the battery pack may comprise a recharge connection for recharging the batteries.

The recharge connection may comprise an induction unit abutting an induction unit in the well, e.g. in a well head or a lubricator, for recharging and/or transmitting and receiving data to and from the wireless downhole unit.

In one embodiment, the batteries may be arranged in rows in the battery holder.

The arrangement of the batteries in rows allows for the use of more conventional batteries and increases the safety due to the fact that if one battery explodes, only one row of batteries will be destroyed, but the batteries in the other rows can still function and power the wireless unit.

Additionally, the driving means may be wheels.

Further, the second diameter may be smaller than the inner diameter of the casing, forming a gap between the expandable device and the casing.

The gap may be 0.1-10 cm, preferably 1-5 cm.

In addition, the expandable device may taper from the second diameter towards the centre.

Moreover, a turbine may be arranged in the aperture for recharging the battery.

Furthermore, the expandable device may take the form of a parachute or an umbrella.

Additionally, the expandable device may be arranged in one end of the unit.

Further, the expandable device may be arranged downstream of the motor, and it may be made of polymer.

Also, the device may comprise a reinforcement, and the reinforcement may be a grid.

The device may comprise ribs for maintaining the shape of the device in its expanded condition.

The present invention furthermore relates to a downhole system comprising a well having a casing and the wireless downhole unit described above.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
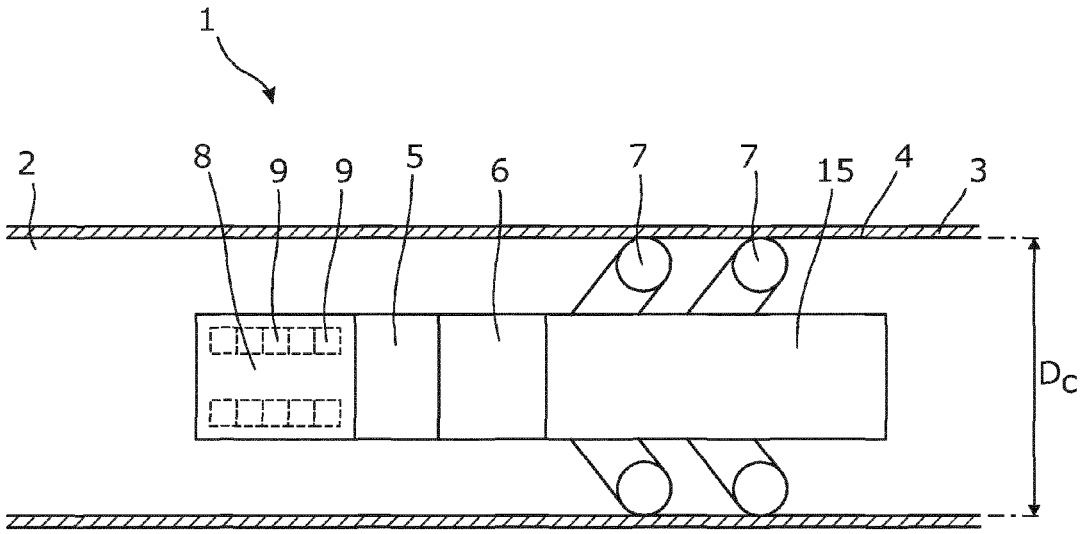
FIG. 1 shows a wireless downhole unit.

FIG. 1 shows a wireless downhole unit 1, 100 arranged inside a casing 3 in a well 2 downhole. The wireless downhole unit 1, 100 comprises a driving unit 15 having driving means 7 in the form of wheels running along an inner wall 4 of the casing 3. The wireless downhole unit 1, 100 is typically used to drive an operational tool into the well 2 to perform an operation, such as opening a sleeve, measuring a temperature and/or pressure of the well fluid, logging the condition of the casing with regard to leaks, etc. The wireless downhole unit 1, 100 is thus connected to a wide range of operational tools and sometimes several tools at a time.

Figure 8:
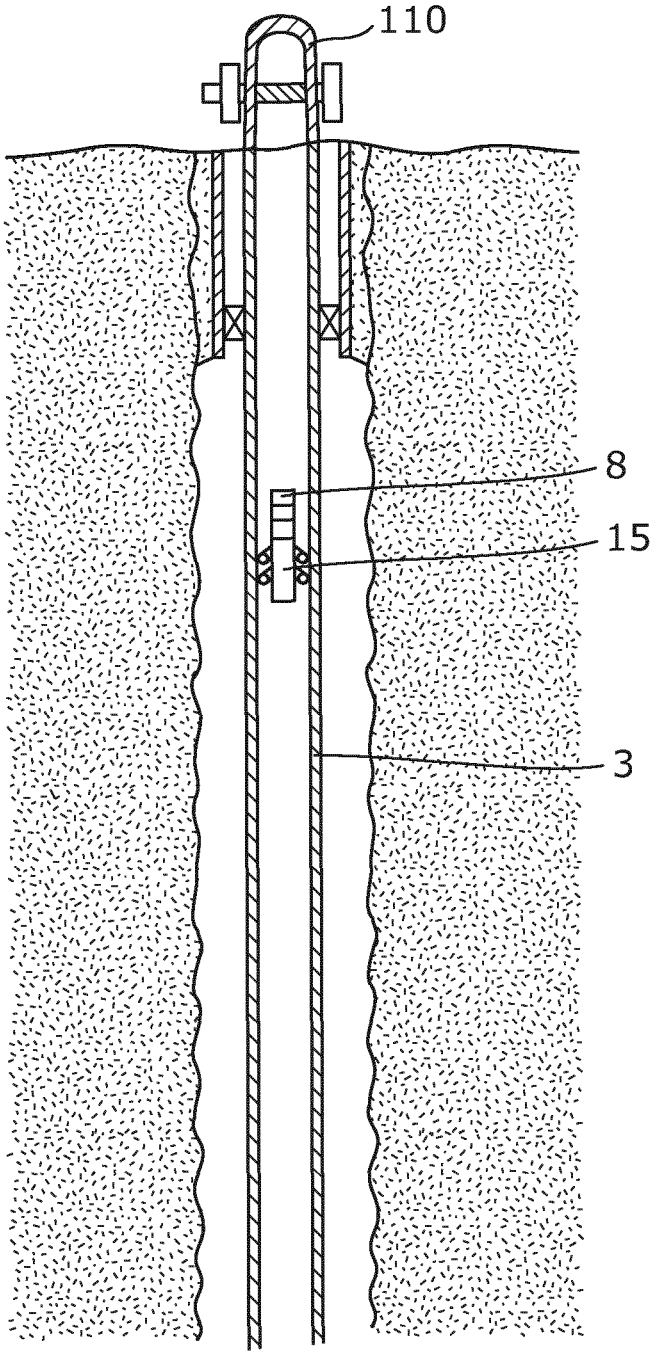
FIG. 8 shows the wireless downhole unit in a well.

In order to propel itself along the casing wall, the wireless downhole unit 1, 100 comprises wheels which are driven by a pump 6 driven by an electrical motor 5. The wireless downhole unit 1, 100 comprises a battery pack 8 for powering the electrical motor 5, comprising a plurality of batteries. The battery pack 8 is arranged in the part of the wireless downhole unit 1, 100 which is closest to the well head 110, as shown in FIG. 8. By placing the battery pack 8 and thus the batteries in the outermost end closest to the top of the well 2, the batteries can easily be recharged or replaced just by entering the well head.

Figure 2:
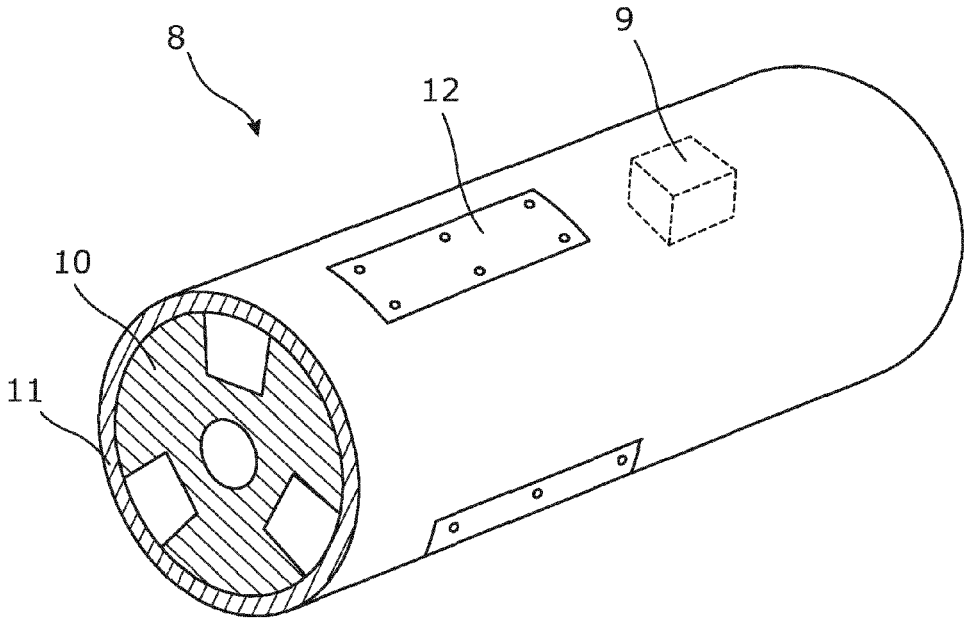
FIG. 2 shows a battery pack.

The batteries are arranged in rows within a housing enclosing a battery holder 10, as indicated by the dotted lines in FIG. 1. As shown in FIG. 2, the holder is formed with grooves corresponding to the shape of batteries arranged in rows and connected in series. The holder is made of a solid material holding the batteries in place while protecting them during movements. The holder may be made of any solid material. The holder being enclosed by the housing allows for the possibility of using lithium batteries although these are not normally suitable for use downhole due to the higher temperature and pressure in the well. Lithium batteries are normally twice as effective as other batteries, which increases the stretch of time of the wireless unit remaining in the well before it has to ascend to recharge or change its batteries. Furthermore, the solid holder allows for the use of a high voltage battery of at least 3 volts, preferably at least 5 volts, more preferably 10 volts. By using high voltage batteries, more power-demanding operations can be performed.

The battery holder 10 is made of a heat-resistant material increasing the protection of the batteries in the battery pack 8. The housing may also be made of a heat-resistant material protecting the batteries from the high temperature and pressure surrounding the battery pack 8. Using high voltage batteries increases the precautionary measures with regard to safety. The heat-resistant material may be polyamide or peek.

As can be seen in FIG. 2, the holder has three elongated grooves in which the batteries are arranged, connected in series. The batteries are inserted into the holder from one end of the battery pack and may easily be replaced when the unit has been used to perform an operation downhole. The arrangement of the batteries in rows allows for the use of more conventional batteries and increases the safety due to the fact that if one battery explodes, only one row of batteries will be destroyed, but the batteries in the other rows can still function and power the wireless unit.

Figure 3:
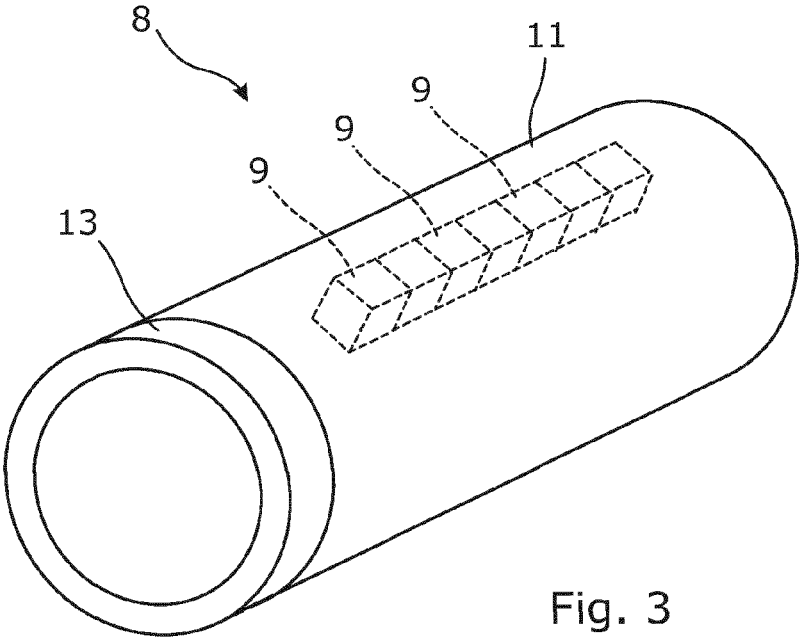
FIG. 3 shows another embodiment of the battery pack.

In FIG. 2, the battery pack 8 comprises a panel 12 which facilitates battery replacement without it being necessary to disconnect the end of the battery pack 8, as shown in FIG. 3. FIG. 3 shows the battery pack 8 comprising a recharge connection 13 for recharging the batteries while still in the well. The recharge connection 13 comprises an induction unit abutting an induction unit in the well 2, e.g. in a well head or a lubricator, for recharging and/or transmitting and receiving data to and from the wireless downhole unit.

Figure 4:
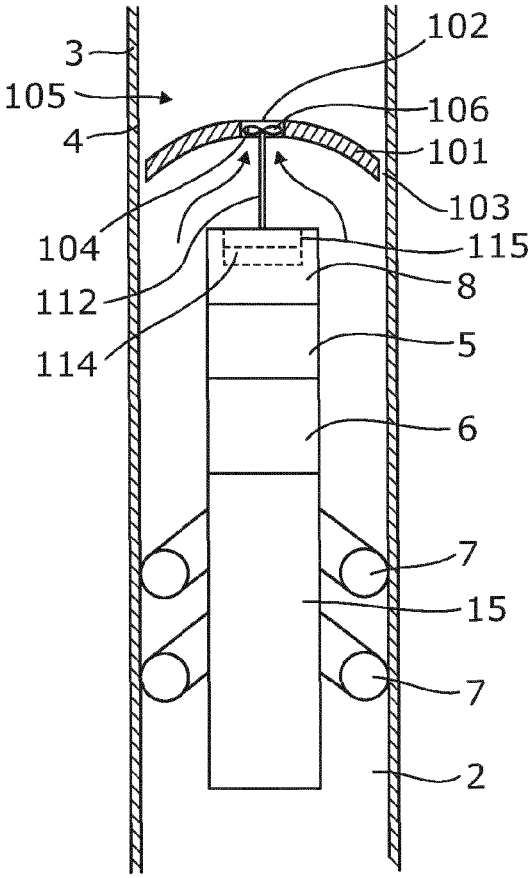
FIG. 4 shows another embodiment of the wireless downhole unit with an expandable device in its expanded condition.
Figure 7:
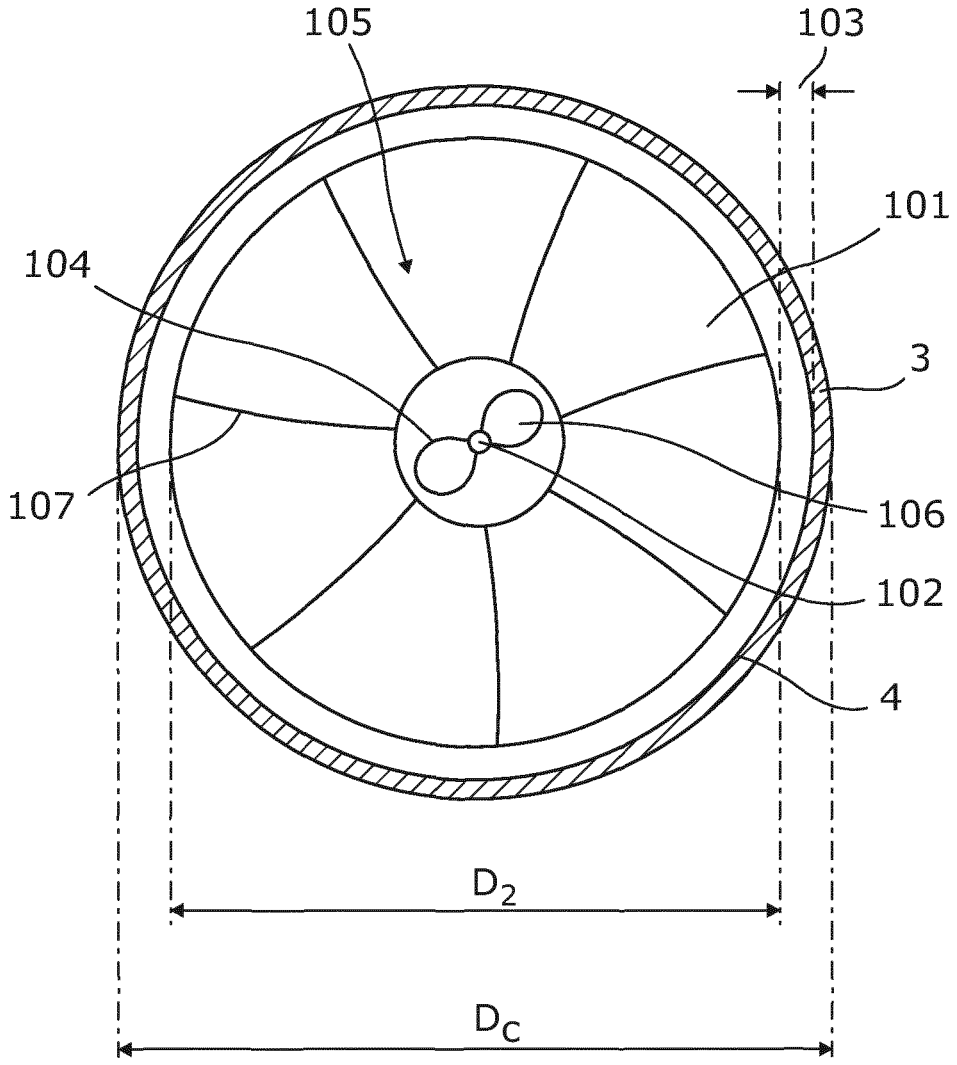
FIG. 7 shows the embodiment of FIG. 4 in its expanded condition.

Another way of recharging the batteries is shown in FIG. 4 where the wireless downhole unit 1, 100 comprises an expandable device 101 which is expandable from a first diameter $D_1$ to a second diameter $D_2$. When the expandable device is in its expanded condition, a gap 103 is formed between the device 101 and the casing 3, as shown in FIG. 7. The formation fluid is then let to flow by opening the valve in the well head, and due to the expanded expandable device 101, the high pressure fluid from the formation is prevented from flowing freely past the wireless downhole unit 1, 100. The expandable device 101 has a centre 102 and an aperture 104 at the centre 102. A propeller 106 of a propeller-driven turbine 105 is arranged on a shaft 112 of the turbine 105 in the aperture 104, and the fluid, which is prevented from flowing past the expandable device 101, is forced to pass through the aperture 104. While passing the aperture 104, the fluid forces the propeller 106 and the shaft to rotate and thereby recharge the batteries via a generator 114 in the turbine converting the rotating energy of the shaft to electricity. The gap between the expandable device 101 and the casing 3 is 0.1-10 cm, preferably 0.5-8 cm, more preferably 2-5 cm. When the batteries have been recharged, the valve is closed again.

Figure 5:
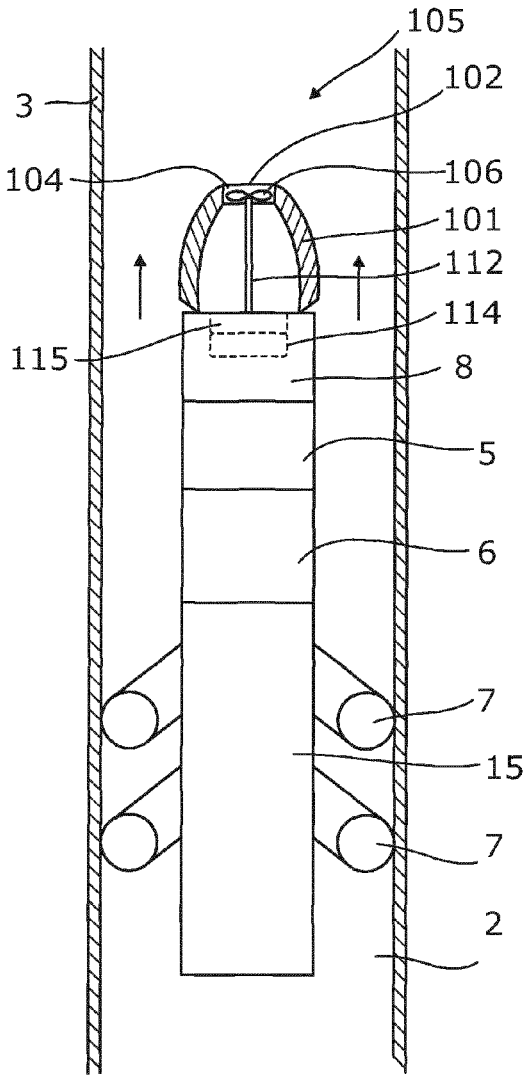
FIG. 5 shows the embodiment of FIG. 4 in its unexpanded condition.

The expandable device 101 tapers from the second diameter towards the centre in order to direct the fluid into the aperture 104. The expandable device 101 is collapsible like an umbrella or a parachute, as shown in FIG. 5.

Figure 6:
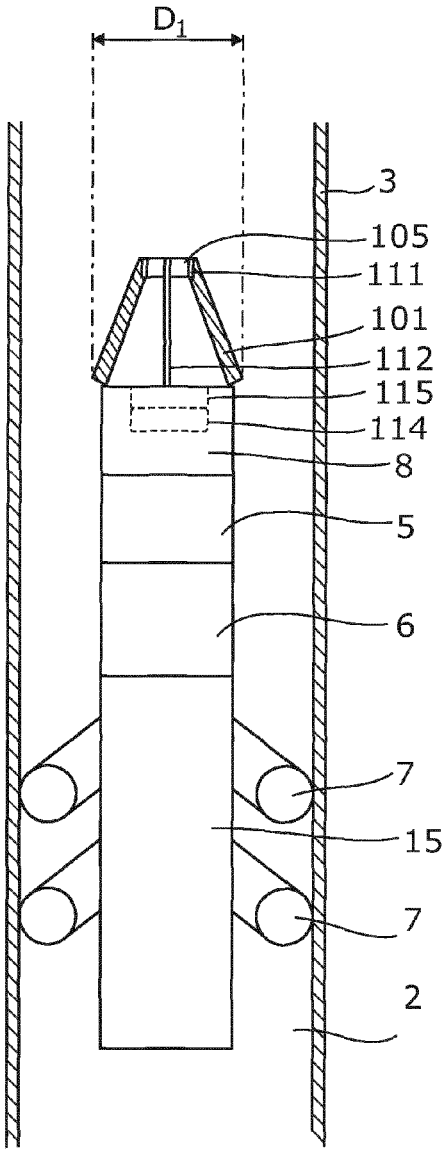
FIG. 6 shows another embodiment of the wireless downhole unit.

In FIG. 6, an impeller 111 of the turbine 105 is arranged in the aperture instead of the propeller, for recharging the battery 9. The impellers 111 are driven by the fluid forced to pass through the aperture and drive the generator 114 in the turbine 105 via a shaft 112 to convert the rotary energy into electricity for recharging the batteries. The expandable device 101 is arranged in one end of the unit downstream of the battery 9 and closest to the top of the well or the well head 110. The expandable device is made of polymer strengthened by an embedded grid or ribs 107 for maintaining the shape of the device in its expanded condition.

In another embodiment, the expandable device 101 does not have an aperture, or the propeller 106 or turbine 105 may be stopped so that the fluid can no longer pass through the centre of the expandable device 101. The expandable device 101 may then be used for moving the wireless unit upwards in the well by means of the pressurised fluid from the formation. Hereby, the wireless downhole unit 1, 100 is able to ascend without having any power left in the batteries by unfolding the expandable device 101.

The expandable device 101 may be designed in a way which causes the turbine 105 or propeller 106 to rotate, but where the wireless downhole unit 1, 100 is still forced upwards by the pressure from the formation fluid. Hereby, the wireless downhole unit 1, 100 is recharged, and when the valve has been closed and the fluid stops flowing, the wireless downhole unit 1, 100 can retract its driving means and move downwards due to gravity.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A wireless downhole unit adapted to be lowered into a well in a casing having an inner wall and an inner diameter, comprising:

an electrical motor, a pump, a driving assembly configured to move the wireless downhole unit within the casing, at least one battery pack comprising at least one battery configured to power the electrical motor, the motor being configured to activate the pump which in turn is configured to activate the driving assembly, wherein the unit comprises an expandable device having a centre and being expandable from a first diameter to a second diameter, the expandable device has an aperture in the centre, and a turbine is arranged in fluid connection with the aperture for recharging the battery.

2. The wireless downhole unit according to claim 1, wherein the battery pack comprises a plurality of batteries and a battery holder for holding the batteries.

3. The wireless downhole unit according to claim 1, wherein the battery is rechargeable.

4. The wireless downhole unit according to claim 1, wherein the battery is a lithium battery.

5. The wireless downhole unit according to claim 1, wherein the battery is a high voltage battery of at least 3 volts.

6. The wireless downhole unit according to claim 1, wherein the battery holder is made of a heat-resistant material.

7. The wireless downhole unit according to claim 6, wherein the heat-resistant material is polyamide or peek.

8. The wireless downhole unit according to claim 1, wherein the battery pack comprises a battery housing enclosing the battery holder, forming a longitudinal space therebetween, in which the batteries can be arranged and connected in series while being kept in place.

9. The wireless downhole unit according to claim 1, wherein the batteries are arranged in rows in the battery holder.

10. The wireless downhole unit according to claim 1, wherein the driving means are wheels.

11. The wireless downhole unit according to claim 1, wherein the second diameter is smaller than the inner diameter of the casing, forming a gap between the expandable device and the casing.

12. The wireless downhole unit according to claim 11, wherein the expandable device tapers from the second diameter towards the centre.

13. The wireless downhole unit according to claim 11, wherein the expandable device is arranged in one end of the unit.

14. The wireless downhole unit according to claim 1, wherein the expandable device is formed as a parachute or an umbrella.

15. The downhole system comprising a well having a casing and the wireless downhole unit according to claim 1.

* * * * *